United States Patent [19]

Sternlicht

[11] 4,408,263

[45] Oct. 4, 1983

[54] DISPOSABLE FLASHLIGHT

[75] Inventor: Mark Sternlicht, Stamford, Conn.

[73] Assignee: Wonder Corporation of America, Norwalk, Conn.

[21] Appl. No.: 330,477

[22] Filed: Dec. 14, 1981

[51] Int. Cl.[3] ..... F21L 7/00

[52] U.S. Cl. ..... 362/189; 362/206

[58] Field of Search ..... 362/189, 206

[56] References Cited

U.S. PATENT DOCUMENTS

| | | | |
|---|---|---|---|
| 3,227,948 | 1/1966 | Cheshire | 200/60 |
| 3,373,737 | 3/1968 | Moore et al. | 200/60 |
| 3,737,650 | 6/1973 | Kaye | 362/205 |
| 3,806,724 | 4/1974 | Tanner et al. | 362/189 |
| 4,237,527 | 12/1980 | Breedlove | 362/189 |

*Primary Examiner*—Stephen J. Lechert, Jr.
*Attorney, Agent, or Firm*—Darby & Darby

[57] ABSTRACT

A disposable flashlight includes a battery and bulb within a casing, a conductive clip engaging the battery and extending through an elongated peripheral slot in the casing, and a conductive member engaging a terminal of the light and extending into proximity with the end of the clip so that the end of the clip can be pushed through a contact opening in the casing into electrical contact with the conductive member to turn the light on. The peripheral slot extends a sufficient distance along the circumference of the casing so that the clip can be rotated within the slot to an "off" position in which its end no longer overlies the contact opening within the casing. In that position, the light cannot be activated when pressure is applied to the clip.

2 Claims, 3 Drawing Figures

DISPOSABLE FLASHLIGHT

The present invention relates to flashlights of the type commonly known as "penlights". More particularly, the present invention relates to an enabling switch for use with disposable penlights wherein a pocket retaining clip is used to turn on the light.

Penlights are small flashlights approximately the size of a pen. They generally include a retaining clip that enables the light to be held within the user's breast pocket in the same fashion as a pen. Many penlights are sold as disposable items (i.e., the batteries are not replaceable) and these disposable penlights usually include an arrangement whereby the clip is used as the on-off switch for the light. In one such arrangement, the clip is electrically and mechanically secured to one of the batteries at its upper end. The casing for the light includes a small opening at the lowermost extremity of the clip so that the user can push the bottom of the clip through the opening into engagement with a conductive surface within the casing to close the circuit between the batteries and light.

During storage and transit, a transparent plastic sleeve is placed over the casing beneath the clip so that the clip cannot be pushed into engagement with the conductive foil within the casing. This is done to prevent inadvertent energization of the light which might deplete or even exhaust the batteries before the device is sold. However, despite all reasonable precautions, many consumers are unaware of the function served by the plastic sleeve and fail to remove the shield before attempting to use the light. On occasion, lights containing the sleeve have been returned to retail outlets by dissatisfied customers contending that the product is inoperable.

OBJECTS OF THE INVENTION

The object of the invention is to provide a disposable flashlight of the type described wherein a separate sleeve or shield is not required to disable the light during transit and storage.

SUMMARY OF THE INVENTION

In accordance with the invention, an elongated peripheral slot is provided in the casing of the flashlight with the clip extending through the casing in such a way that the clip can be rotated about the axis of the light between "off" and "on" positions. In the "off" position the end of the clip cannot be made to close the circuit to the light, but in the "on" position, the clip end can be pushed through a contact opening in the casing into contact with a conductive member within the light. During transit and storage, the clip is rotated to the "off" position. When it is desired to use the light, the user simply rotates the clip to the "on" position, which may be clearly marked on the casing, and the light can then be used in conventional fashion.

THE DRAWINGS

DETAILED DESCRIPTION

Figure 1:
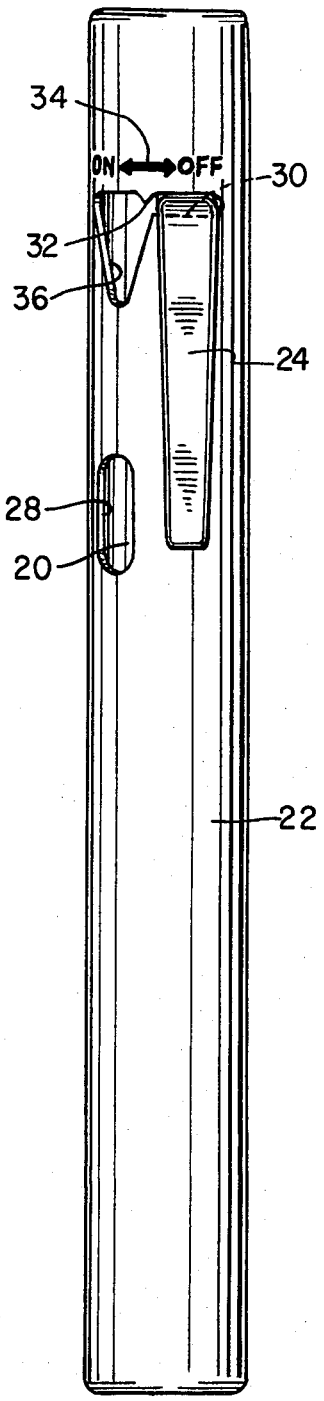
FIG. 1 is a front view showing the clip of the flashlight in the "off" position.

As indicated above, the basic construction of the flashlight itself is conventional. It includes batteries 10 and 12 (FIG. 3) and a light 14 having electrical terminals 16 and 17. The batteries, which include no insulating coverings, are placed within a cylindrical paper tube 18 having a conductive foil 20 on its outer surface. The conductive foil 20 is folded over onto the lower portion of the inner surface of tube 18 so that it contacts the light terminal 16. The terminal 16 is pressed into the lowermost part of tube 18.

Figure 3:
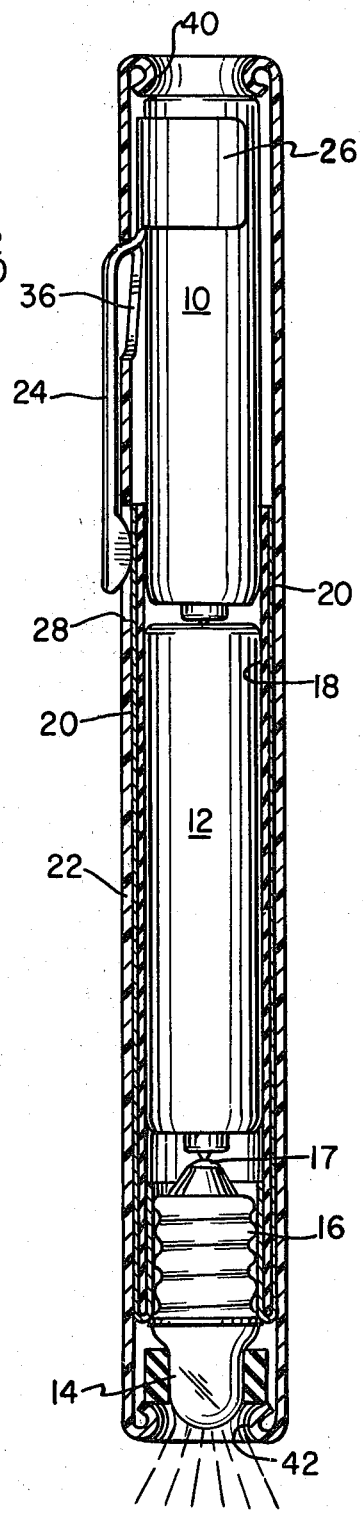
FIG. 3 is a sectional view along the line 3—3 of FIG. 2 with the clip in contact, i.e., in the "on" position.

The parts described are housed within a casing 22 made of an insulating material (e.g., plastic). A pocket clip 24 includes a resilient C-shaped clamping member 26 which is secured mechanically and electrically to the metallic case of battery 10, the negative terminal of the battery. The flashlight casing 22 includes a contact opening 28 through which the lower end of the clip 24 can be pushed to engage the conductive foil 20 as shown in FIG. 3. This closes a circuit from the batteries 10 and 12 through clip 24 and foil 20 to the terminal 16 and thread terminal 17 of the light 14.

Figure 2:
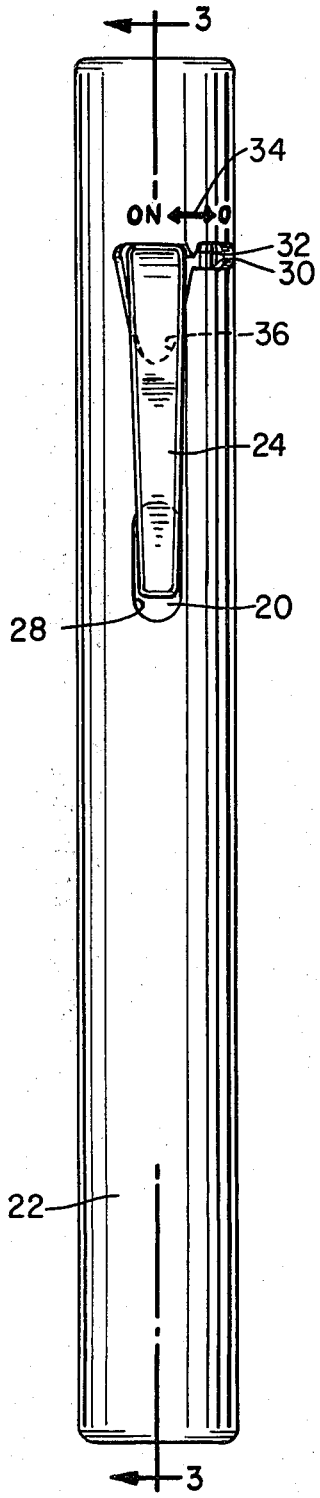
FIG. 2 is a view similar to that of FIG. 1, but showing the clip of the flashlight in the "on" position.

In accordance with the invention, a peripheral slot 30 is provided in the casing. The clip 24 extends through slot 30 so that the clip (with battery 10) can be rotated to either end of the slot 30. When the clip 24 is rotated to the left as viewed in FIG. 2 (the "on" position) the end of the clip 24 overlies the contact opening 28 and, in this position, the light can be used in conventional fashion. However, when the clip 24 is rotated to the right-hand extremity of the slot 30 (FIG. 1), the "off" position, the end of the clip 24 no longer overlies the contact opening 28 and, in that position, the circuit cannot be disclosed.

A small detent 32 is provided intermediate the "on" and "off" positions so that the clip will tend to remain in the position to which it has been rotated by the user. An on-off indicator arrow 34 may be printed or molded on the casing immediately above the slot 30 so that even the most casual consumer will understand that the clip 24 must be rotated to the left when the light is to be used.

The peripheral slot 30 includes a generally triangularly shaped extension 36 beneath the "on" indicator. This section 36, in known fashion, enables the clip 24 to be inserted into casing 22 during the assembly procedure prior to insertion of the battery 10 and final closure of the casing 22. Since both ends of the casing 22 are permanently curled at 40 and 42, the batteries cannot conveniently be removed after they are depleted; thus, the light is deemed "disposable".

Because of the enabling arrangement in accordance with the invention, it is not necessary to place a plastic sleeve between the bottom of clip 24 and the contact opening 28 when the light is not in use. At the time of manufacture, the clip 24 is simply rotated to the "off" position in which the light cannot be turned on. The consumer who purchases the light enables the on/off switch by rotating the clip 24 (and battery 10) to the "on" position where it can be used in standard fashion. When the user wishes to disable the light to prevent accidental discharge, he or she need no longer be concerned with a separate sleeve which is easily misplaced, but simply rotates the clip back to the "off" position.

What is claimed is:

1. In a disposable flashlight having a battery and light within a casing, a conductive clip engaging the battery, and a conductive member engaging a terminal of the light and extending into proximity with the end of the clip so that the end of the clip can be pushed through a contact opening in the casing into electrical contact with said conductive member to turn on the light, the improvement comprising, a peripheral slot in the casing through which the clip extends, said slot extending a distance along the circumference of the casing such that the clip can be rotated to an "off" position where said clip end does not overlie said contact opening to thereby prevent the light from being energized by the application of pressure to said clip end, said slot further including a detent between its ends so as to retain the clip in its "off" and "on" positions.

2. The improvement in a clip light according to either of claims 1, wherein the casing includes an on-off indicator marking adjacent said slot.

* * * * *